United States Patent [19]

Fisher, Jr.

[11] 4,289,200

[45] Sep. 15, 1981

[54] RETRIEVABLE WELL APPARATUS

[75] Inventor: Hiram H. Fisher, Jr., Houston, Tex.

[73] Assignee: Baker International Corporation, Orange, Calif.

[21] Appl. No.: 190,308

[22] Filed: Sep. 24, 1980

[51] Int. Cl.[3] ..... E21B 33/124; E21B 23/06; E21B 33/129

[52] U.S. Cl. ..... 166/120; 166/182

[58] Field of Search ..... 166/120, 182

[56] References Cited

U.S. PATENT DOCUMENTS

| | | | |
|---|---|---|---|
| 3,749,166 | 7/1973 | Young | 166/134 |
| 3,797,572 | 3/1974 | Mignotte | 166/134 |
| 3,818,987 | 6/1974 | Ellis | 166/134 |
| 4,018,272 | 4/1977 | Brown et al. | 166/120 |
| 4,078,606 | 3/1978 | Montgomery | 166/120 |
| 4,151,876 | 5/1979 | Briggs et al. | 166/182 |

*Primary Examiner*—James A. Leppink

[57] ABSTRACT

A retrievable well packer includes telescopingly interfitted housing and mandrel members movable one relative to the other to actuate the seal and anchor systems for setting the packer. A locking mechanism for holding the packer in the set position includes a cylindrical lock ring having axially spaced ratchet teeth, referred to in the art as wickers, on an outer circumferential surface engageable with cooperating internal axially spaced ratchet wickers formed on the housing member. The lock ring also includes axially spaced teeth on an inner circumferential surface engageable with cooperating teeth on a collapsible latch system engaged with the mandrel which may be collapsed radially inwardly to release the lock ring with respect to the mandrel to permit relative movement between the mandrel and the housing to release the packer elements from engagement with the casing. The collapsible latch system is held in position by a supportive sleeve slidably disposed in a bore formed in the mandrel and held in its retaining position by shear pins. The arrangement of the mandrel and housing and the latching and releasing mechanism is adapted for use in well tools of all types and may be set by fluid pressure applied to an expansible chamber, within the apparatus, by various wireline setting tools adapted to move the mandrel with respect to the housing, or mechanically, and can be retrieved simply by shifting the supporting sleeve to release the latch system and lifting the tool by the mandrel.

8 Claims, 15 Drawing Figures

RETRIEVABLE WELL APPARATUS

BACKGROUND OF THE INVENTION

1. Field of the Invention

The present invention relates to downhole tools typically used in the oil and related industries for providing an annular seal and/or anchor system between one conduit disposed in another, the most common example being referred to as a packer, which also includes an anchor system and provides an annular seal between the production tubing and the casing.

2. Background Art

There are many different downhole tools in the oil industry which require that a seal be established in the annulus between one conduit and another in the well such as between the well bore or the well casing, and well tubing or the like. These tools may relate to the drilling and completion of the well, the production of the well, servicing of the well, or abandonment of the well. Some such tools also require an anchoring system for holding the seal in position against either upwardly or downwardly acting pressure differentials, and in many tools, it is highly desirable or an absolute requirement to be able to release the seal system and/or the anchoring system and retrieve the tool with minimum effort.

One of the more common examples of downhole tools of this type is the packer used to provide an annular seal between the production tubing and the bore hole casing. Such packers are typically run and set in place either by on a tubing string, or a wire line setting tool. When set using a tubing string, the packer is typically set using hydraulic pressure in the tubing, hydrostatic pressure in the well bore or a combination of both, and also mechanically by the weight of the tubing. In most cases it is desirable to guard against premature setting by some tripping mechanism. Such packers can either be made as a combination of the tubing string, in which case the interior conduit of the packer is connected at top and bottom to the tubing, or can be a permanent type packer with an internal seal bore and latching system for receiving a seating nipple with latch so that the tubing can be retrieved while leaving the packer set in place. Either type of packer may be used to support tubing loads hanging from the bottom of the assembly or set in the top of the assembly. These types of packers may be associated with safety systems, expansion joints, multiple packer systems, or multiple tubing strings for multiple production zones.

In the past each type of tool tended to have markedly different construction and components to attain the features and performance necessary for specific applications. These tools tend to be complex, long, and expensive to manufacture, and the large number of different parts required for the multitude of different tools creates additional costs related to the large inventories of parts required.

SUMMARY OF THE INVENTION

The present invention is concerned with a basic mechanism for tools of the type described which is simple, has a minimum number of parts, and minimum length, and is therefore relatively inexpensive to manufacture. The basic mechanism can advantageously be used in substantially all types of tools, including hydraulic set, wireline set, and mechanical set, and can be of the free standing steel bore or permanent type, can be incorporated in the tubing string, and can function where loads are suspended from either the bottom or the top of the tool. The tool may be retrieved simply by shifting a sleeve axially by an appropriate retrieving tool or similar mechanism.

The tool in accordance with this invention includes an inner tubular mandrel having a first seal urging member at one end and a housing assembly disposed around the other end of the mandrel which has a second seal urging member spaced from the first. An annular seal assembly is disposed between the two seal urging members which will expand into sealing engagement with the casing or the like when a compressive force is applied by movement of the mandrel relative to the housing so as to move the seal urging means together. The housing assembly may also include a conventional slip assembly to anchor the device in response to such relative movement of the mandrel and housing. A latching system cooperates directly between the mandrel and housing to directly capture the relative movement of two parts and thereby maintain the set of the sealing and/or anchoring assemblies. The latching system includes a sleeve disposed within the mandrel which can be accessed and axially shifted from within the mandrel to release the latching system and permit the mandrel and housing to return to the respective original positions and thereby release the sealing and/or anchoring assemblies. More specifically, the latch assembly includes a lock ring which is coupled to the housing by cooperating ratchet threads, referred to in the art as wickers, and is releasably coupled to the mandrel by a collapsible coupling means moveable between an outer position where it is coupled with the lock ring to an inwardly shifted collapsed position where it is decoupled from the lock ring. The shiftable sleeve supports the collapsible coupling means in the outer coupled position, and permits it to collapse to the decoupled position when shifted.

The mandrel may be shifted relative to the housing to apply the compressive force to the sealing and/or anchoring systems by means and an expansible fluid chamber for receiving fluid under pressure, by a wireline setting tool and adapter kit engaging the respective members, or mechanically by the weight of the tubing. The tubing or equivalent string may be coupled to the end of the mandrel either permanently or by a latching seal assembly inserted in a seal bore in the mandrel, with any continuation of the tubing connected either to the lower end of the mandrel or to the lower end of the housing. In the latter case, any load disposed below the tool may be transferred through cooperative shoulders on the mandrel and housing. The sleeve may be shifted to release the tool by any element passing through the mandrel and the same element may be used to lift the mandrel through the sleeve and thereby retrieve the tool and any load suspended therefrom.

In another embodiment of the invention the seal urging means on the mandrel may be moved toward the seal urging means on the housing, typically by a wireline setting tool and adapter kit, to provide the compression to expand the seal system and/or engage the anchor system. In this case the lock ring is disposed between the mandrel and the mechanism moving the seal urging means, while the collapsible latch and shiftable sleeve are disposed directly between the housing and the mandrel to release the tool.

DESCRIPTION OF THE PREFERRED EMBODIMENTS

Figure 1A:
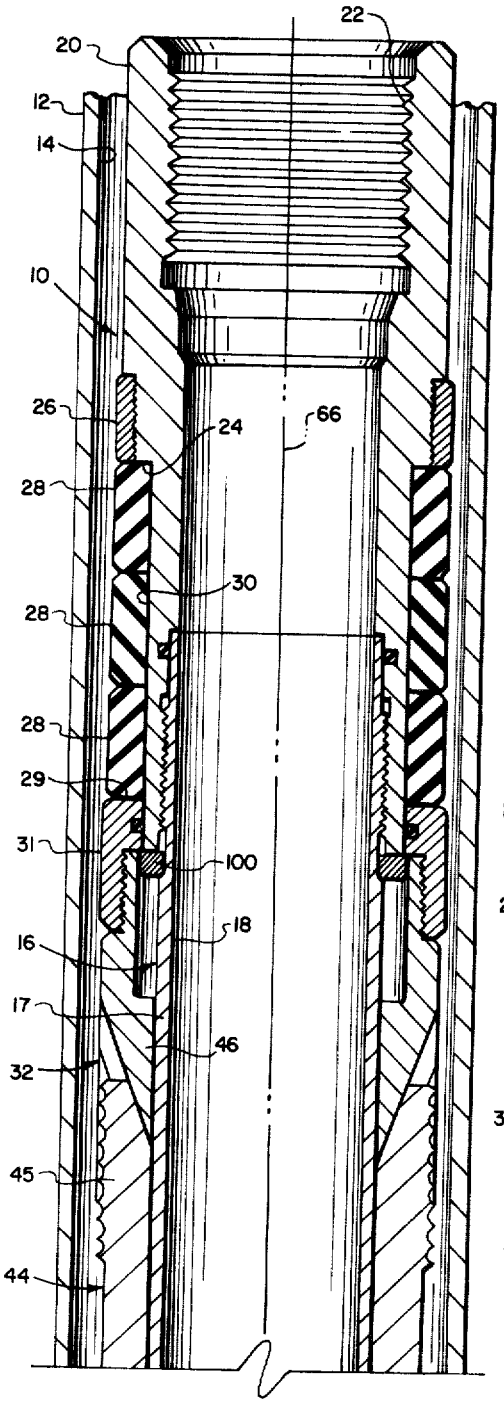
FIGS. 1A through 1C together comprise a vertical elevation view, in section, of a packer in accordance with the present invention.

In the drawings, the figures with combined number and letter designations are intended to be viewed together arranged vertically end to end with the first letter designation as the top section of the view and the last letter designation as the bottom section. In the following description the terms upper and lower are used for convenience in regards to the normal arrangement of the packer components when the packer is being inserted in a generally vertically disposed well casing. However, for many applications, the apparatus may be inverted if desired.

Figure 1B:
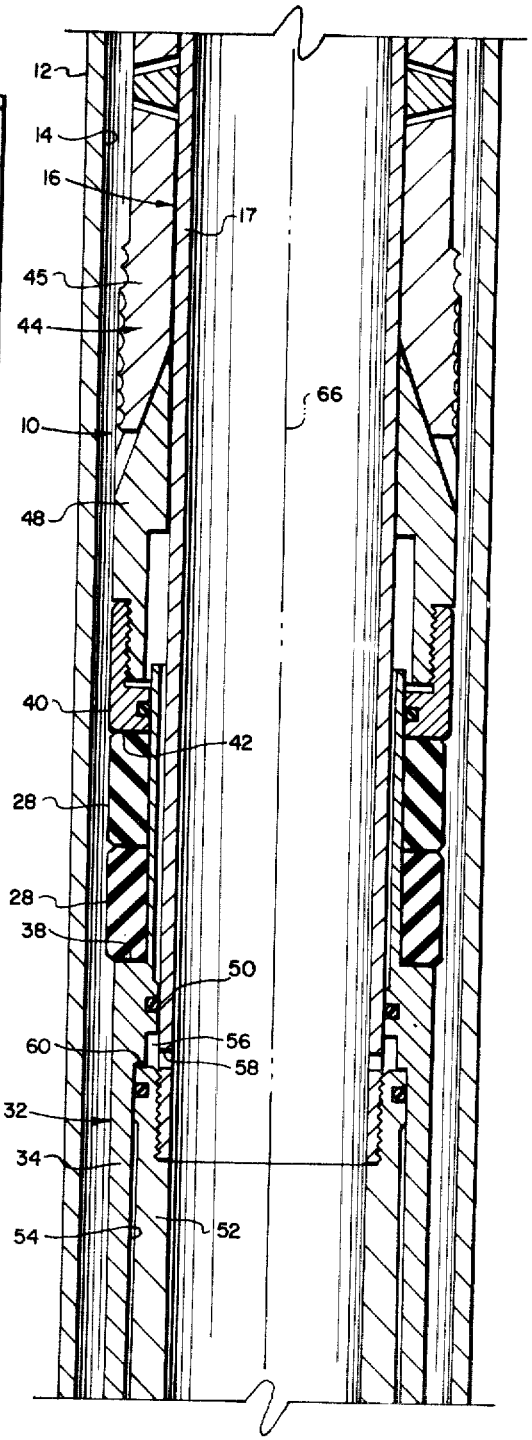
Figure 1C:
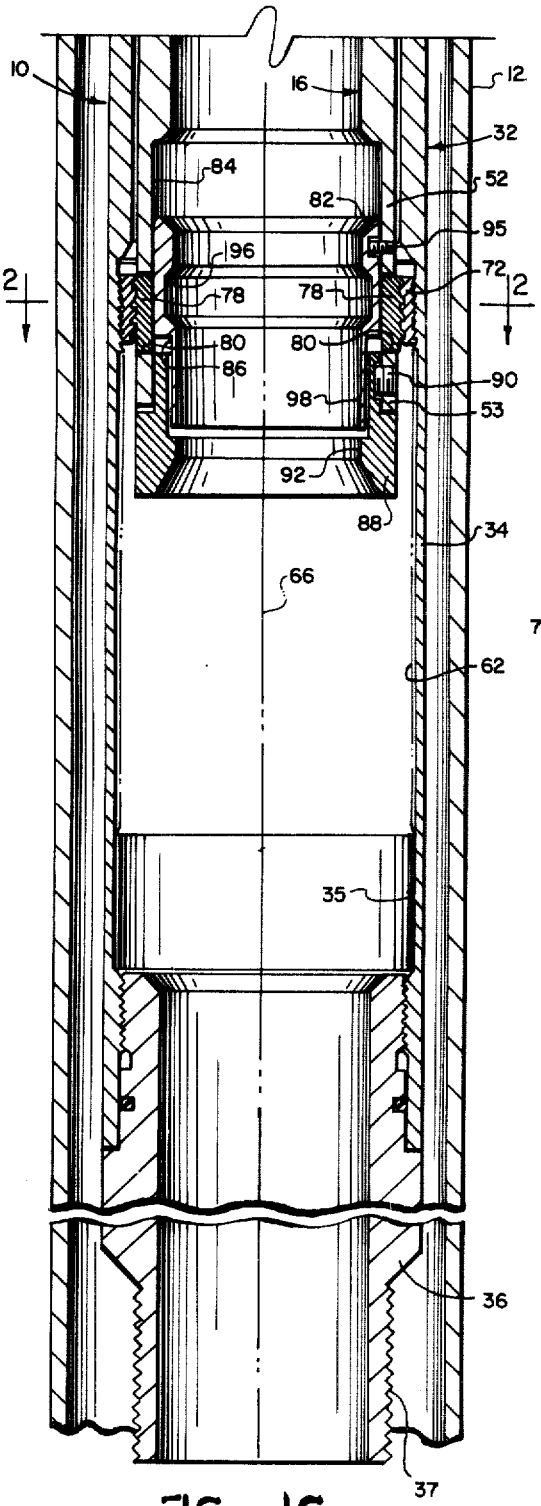

Referring to FIGS. 1A through 1C, a retrievable well packer is illustrated and generally designated by the numeral 10. The packer 10 is adapted to be lowered from the top of a well to a selected location in a well casing 12, uncased borehole or the like, and to be set with respect to the inner wall 14 of the well casing and to form a fluid tight seal therewith. The packer 10 may be the only packer in the casing or there may be a plurality of packers spaced axially along the casing. The packer 10 is adaptable to a variety of installations in connection with various well operations.

Referring to FIG. 1A the packer 10 includes an elongated tubular mandrel, generally designated by the numeral 16. The mandrel 16 includes a bore 18 through which various well tools may be run into and out of the well and also into which pressure fluid may be introduced for various operations. The mandrel 16 includes an upper sub 20 threadedly connected to an elongated tubular portion 17 and including internal threads 22 for connection to a tubing string or a setting tool. The sub 20 includes a downwardly facing annular seal urging shoulder 24 adjacent to a cylindrical gauge ring 26. The shoulder 24 is adapted to forcibly engage one side of one of a plurality of resilient deformable packing or sealing elements 28 disposed in side by side relationship on a reduced diameter portion 30 of the sub 20.

The lowermost sealing element 28 is engaged on one side thereof with an upwardly facing annular seal urging shoulder 29 of a cylindrical gauge ring 31. The gauge ring 31 is removably fixed to, and comprises a part of, an elongated housing generally designated by the numeral 32. Referring also to FIGS. 1B through 1C, the housing 32 includes an elongated tubular member 34 threadedly connected to a bottom sub 36 having external threads 37 on the distal end thereof. The tubular member 34 includes an annular shoulder 38 which is in abutting engagement with additional sealing elements 28 disposed between the shoulder 38 and a ring member 40 having a downwardly facing shoulder 42.

The housing 32 includes a system of radially movable anchor slips, generally designated by the numeral 44, which are operable in a well known way to move radially outwardly into gripping relationship with the inner wall 14 of the casing 12 in response to axial movement of the mandrel 16 with respect to the housing 32. The slip system 44 includes upper and lower housing portions 46 and 48 which are adapted, in response to movement of the mandrel 16 with respect to the housing 32, to force slip members 45 radially outwardly into gripping engagement with the casing 12. The slip system 44 is of a known configuration and is preferably of a type, for example, similar to that used on the model "Retrieva D" retrievable well packer manufactured by Baker Packers Completion Systems, Houston, Tex. Suffice it to say that the slip system 44 is generally known in the art of well packers and is advantageously used in conjunction with the packer 10.

Referring to FIG. 1B, the mandrel 16 is longitudinally movable with respect to the housing 32, including the members 34 and 36 and the slip system 44, and is sealingly engaged with an inner wall of the housing member 34 by a suitable seal 50 comprising an o-ring, for example. The mandrel 16 also includes an enlarged diameter portion 52 threadedly connected to the lower end of member 17 and slidable along an enlarged diameter bore 54 in the housing member 34. The mandrel 16, including the portion 52, together with the housing member 34 forms an expansible chamber 56 having a passage 58 opening into the bore 18. Pressure fluid may be introduced into the chamber 56 to act against an axially projecting end face 60 of the portion 52 and cooperating axially projecting surfaces on the housing member 34 to produce movement of the mandrel 16 with respect to the housing 32 when it is desired to engage the slips 45 with the inner wall of the well casing followed by radial outward deformation of the resilient sealing elements 28 into sealing engagement with the casing wall in the set position of the packer.

The packer 10 includes an improved latch assembly operable to lock the mandrel 16 with respect to the housing 32 when the packer has been set and the sealing elements engaged with the casing wall to hold the packer in the set position. The improved latch assembly of the present invention also includes means for disengaging the latch system to permit movement of the mandrel 16 with respect to the housing 32 to release the gripping and sealing engagement of the packer with the well casing so that the packer may be removed from the well.

Figure 2:
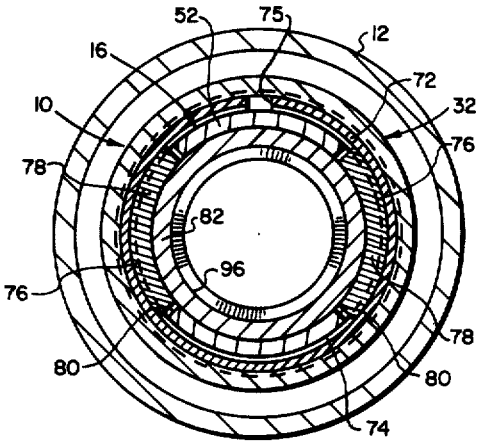
FIG. 2 is a transverse section view taken from the line 2—2 of FIG. 1C.
Figure 3:
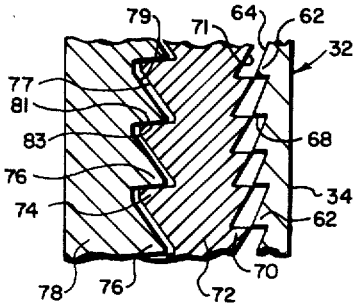
FIG. 3 is an enlarged detail longitudinal section view of the lock ring showing the relative position of the ratchet teeth or wickers on the respective members when the locking mechanism is being moved to the setting position.

Referring to FIG. 1C, FIG. 2 and FIG. 3, an inner wall portion 35 of the housing member 34 includes a series of relatively fine pitched axially spaced teeth or wickers 62 which, as shown in FIG. 3, are generally radially inwardly projecting. The teeth 62 include first flank portions 64 formed at an acute angle with respect to the longitudinal axis 66 of the packer 10, and second flank portions 68 disposed at almost a right angle to the longitudinal axis. The teeth 62 are adapted to be engaged by cooperating axially spaced teeth 70 formed on the outer cylindrical surface of a lock ring 72. As shown in FIG. 2 the lock ring 72 has an axial slot 75 extending the length of the ring to permit generally radially inward constriction of the ring when the ring is forced to move axially in one direction with respect to the teeth 62 on the housing member 34. As shown in the drawing figures the lock ring 72 also includes axially spaced teeth or wickers 74 disposed on the inner cylindrical wall of the ring and which are engaged with cooperating teeth 76 formed on the outer cylindrical surface of a pair of diametrally opposed cylindrical segments 78 of a collapsible latching system that is coupled to the mandrel 16. The arrangement of the cooperating teeth 62 and 70 and the cooperating teeth 74 and 76 permits movement of the mandrel 16 downwardly with respect to the housing 32, viewing FIGS. 1A through 1C, but prevents movement of the mandrel 16 with respect to the housing in the opposite or upward direction.

Referring to FIGS. 1C and FIG. 2 the segments 78 are disposed in axially extending slots 80 formed in the cylindrical tubular wall of the distal end of the mandrel portion 52. The slots 80 have an annular sector shape when viewed in transverse section as shown in FIG. 2. The segments 78 are dimensioned to be radially inwardly movable in the slots 80 a sufficient distance to disengage the teeth 76 from the teeth 74 but not displaceable entirely from the slots. The segments 78 are retained in the slots 80 in the position shown in FIG. 1C and FIG. 2 by a tubular sleeve 82 adapted to be slidably fitted in close fitting relationship with the inner wall 84 of the member 52. The sleeve 82 includes an annular recess 86 which, as shown in FIG. 1C, extends within an end cap 88 removably attached to the distal end 53 of the mandrel portion 52 by suitable radially disposed fasteners 90, one shown in FIG. 1C. The end cap 88 includes a flared axially extending bore 92 coextensive with a bore 98 to permit movement of tools through the bore of the mandrel without accidental engagement of the sleeve 82. The sleeve 82 is retained in the position shown in FIG. 1C and FIG. 2 by radially projecting shear pins 95, one shown, mounted on the mandrel portion 52, and which are characterized as socket head screws of a known dimension and having a known shear strength. The sleeve 82 is also provided with an annular recess 96 formed in the bore 98 which is adapted to be engaged by a suitable retrieving tool whereby the sleeve 82 may be forcibly moved axially upward to shear the pins 95 and move the recess 86 into position adjacent to the slots 80. In such a position of the sleeve 82 the segments 78 may move radially inwardly with respect to the axis 66 into the recess 86 a sufficient distance to cause disengagement of the teeth 74 and 76 to release the locking interconnection between the mandrel 16 and the housing 32 so that the mandrel and housing members may move with respect to each other to release the slip system 44 and the sealing elements 28. Accordingly, the latching mechanism of the present invention is also advantageously provided with means which provides for release of the lock ring 72 with respect to the mandrel. The combining of the locking and releasing function in one compact and mechanically uncomplicated mechanism is particularly advantageous for retrievable well packers whereby the overall structure of the packer is simplified, the reliability of its operation is improved and the packer may be more compactly built and more economically manufactured than prior art packers.

Referring again to FIG. 3, the teeth 74 and 76 are provided with cooperating axially inclined flank portions 77 and 79, respectively, which cooperate to tend to force the segments 78 radially inwardly and to force the ring 72 to expand radially outwardly into positive locking engagement of the teeth 70 with the teeth 62 to prevent movement of the ring 72 upwardly, viewing FIG. 3. The teeth 74 and 76 are also provided with cooperating abutting flanks 81 and 83 which project substantially radially and permit radial inward constriction of the ring 72 when the ring is moved downward, viewing FIG. 3, with respect to the housing member 34. The radial depth of the cooperating teeth 74 and 76 is greater than the radial depth of the interfitting teeth 62 and 70 to assure that the teeth 62 and 70 may ratchet over each other when the ring 72 is to be moved downward with respect to the housing member 34, as shown in FIG. 3. Moreover, the angle of the flank 64 of the teeth 62 with respect to the axis 66 has been deemed to preferably be less than the angle formed by the corresponding flank 71 on the teeth 70 to facilitate engagement of the teeth 62 and 70 under conditions when contaminated fluids and other debris may be allowed to circulate through the interior of the packer before it is set. The cooperating teeth 62 and 70 as well as the teeth 74 and 76 are preferably formed as helical threads to facilitate assembly of the locking mechanism as well as manufacturing of the various components on which the teeth are respectively formed.

The packer 10 may be operated to be set to cause the sealing elements 28 to engage the inner wall of the casing 12 by various setting procedures including the use of pressure fluid to move the mandrel 16 with respect to the housing 32 as described hereinabove. If a hydraulic setting operation is to be performed the packer 10 is connected by means of the threads 22 to the lower end of a tubing string and run to setting depth with an expendable plug disposed at the lower end of the packer and bridging the bore 18 to form a fluid tight seal within the bore 18. Pressure fluid is then admitted to the bore 18 and through the passage 58 into the chamber 56 whereby the mandrel 16 will undergo axial movement with respect to the housing 32 to engage the slips 45 with the well casing followed by engagement of the sealing elements 28. As the mandrel 16 is moved with respect to the housing 32 the cooperating teeth 62 and 70 will force radial inward constriction of the ring 72 to allow the ring to ratchet along the teeth 62 until the packer is in the set position. As the mandrel 16 attempts to move in the opposite direction with respect to the housing 32, for example, due to the elastic deformation of the resilient sealing elements 28, the teeth 62 and 70 will engage forcibly to prevent movement of the ring 72 and the mandrel 16.

When it is desired to release the packer 10 for retrieval a retrieving tool similar to, for example, a Baker Packers Product Number 646-17 may be operated to engage the threads 22 of the sub 20 and the annular recess 96 in the sleeve 82 and axially displace the sleeve upwardly to shear the pins 95 whereby the segments 78 will move into the recess 86 to release the locking interconnection between the mandrel 16 and the housing 32. As the mandrel 16 moves in the direction opposite to that which resulted in setting of the packer the sealing elements 28 will resume their relaxed configuration and the housing member 46 will be moved longitudinally with respect to the housing member 48 by engagement of the annular collar 100 with a transverse edge on the gauge ring 31. Once the element 28 and slips 45 have moved away from the wall 14 the packer may be retrieved in a known manner.

The packer 10 may also be set by mechanically engaging the sub 20 and the sub 36 with one or more of a variety of suitable setting tools or assemblies which, upon energization, provide for movement of the mandrel 16 downwardly with respect to the housing 32 as shown in FIGS. 1A through 1C.

An second embodiment of the present invention is illustrated in FIGS. 4A through 4D and FIG. 5, and is generally designated by the numeral 110. The packer 110 is also adapted for insertion in the well casing 12, and is particularly adapted for use in applications in which relatively heavy tubing strings or tailpipe loads are to be carried by the bottom sub of the packer. The packer 110 includes an elongated mandrel generally designated by the numeral 116. The mandrel 116 includes a tubular portion 117 having a bore 118 and threadedly engaged with a top sub 120. The sub 120 includes a downwardly facing annular shoulder 124 engaged with one of a plurality of sealing elements 28 arranged in a manner similar to the packer 10. The mandrel 116 further includes a second tubular member 152 threadedly engaged with the member 117 at one end thereof and also threadedly engaged with a bottom sub 136 at the opposite end. Accordingly, the mandrel 116 is a continuous member from the sub 120 to the sub 136 which provides for the capability of the packer 110 to carry relatively heavy loads connected to the sub 136 below the packer.

The packer 110 includes an elongated outer housing, generally designated by the numeral 132, including a member 134, and a slip system 144 similar to the slip system 44 of the packer 10. The slip system 144 includes spaced apart housing members 146 and 148 adapted to move slips 145 radially outwardly against the inner wall of a well casing such as the casing 12 shown in FIG. 1A. The housing member 146 includes a reduced diameter axially projecting portion 147 which is suitably connected to a further tubular member 149 having an upwardly facing annular shoulder 129. The shoulder 129 is adapted to be engaged with a sidewall of one of the sealing elements 28. The member 149 is fixed to the member 146 by a threaded fastener 150 projecting radially inwardly through a cooperating hole 155 in the member 147 and into an elongated slot 154 in the outer cylindrical wall of the member 117.

The packer 110 includes an elongated sleeve-like piston 156 which is sealingly engaged with the outer circumferential wall of the member 117, the inner wall 121 of the sub 120 and the inner wall 151 of the member 149. The piston 156 also is disposed inside the annular sealing elements 28 in supporting relationship thereto. The piston 156 divides an annular space between the member 117 and the housing 149, as well as the sub 120, into respective chambers 158 and 160. The chamber 158 is vented through a radial passage 159 and the chamber 160 is suitably vented through clearance spaces formed between the member 146 and the member 117.

Figure 4A:
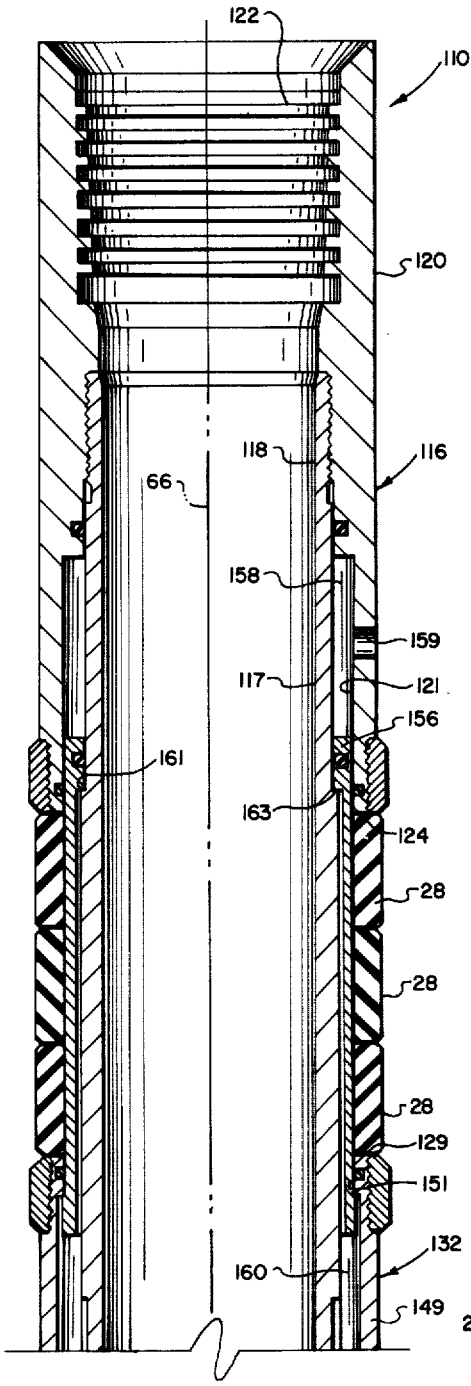
FIGS. 4A through 4D together comprise a vertical elevation, in section, of an alternate embodiment of the present invention.
Figure 4B:
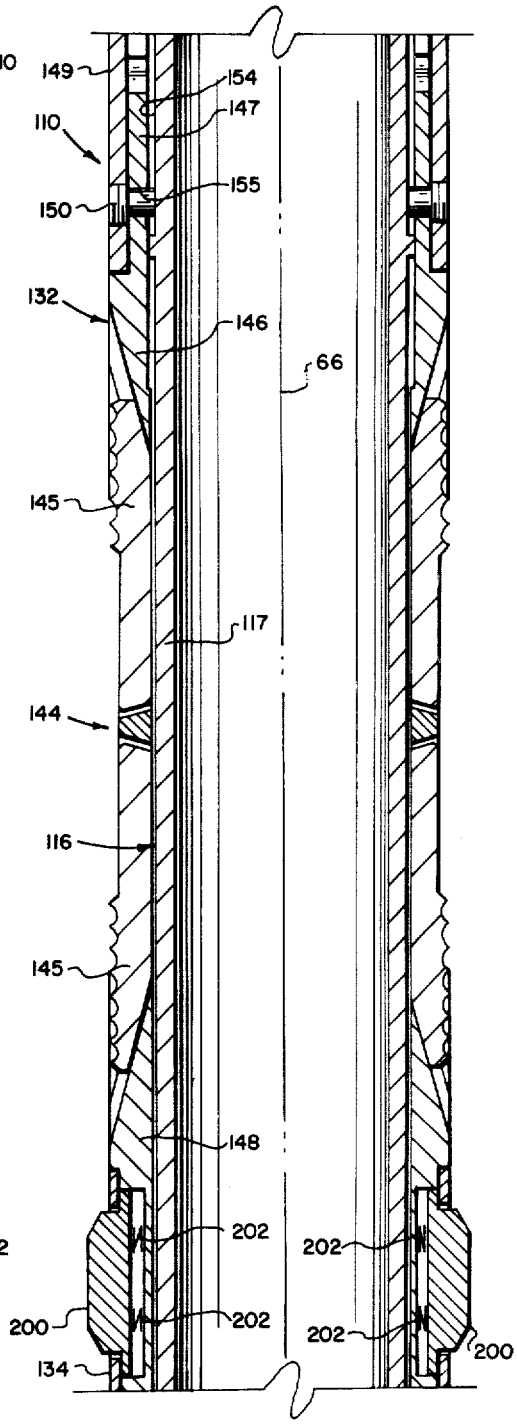
Figure 4C:
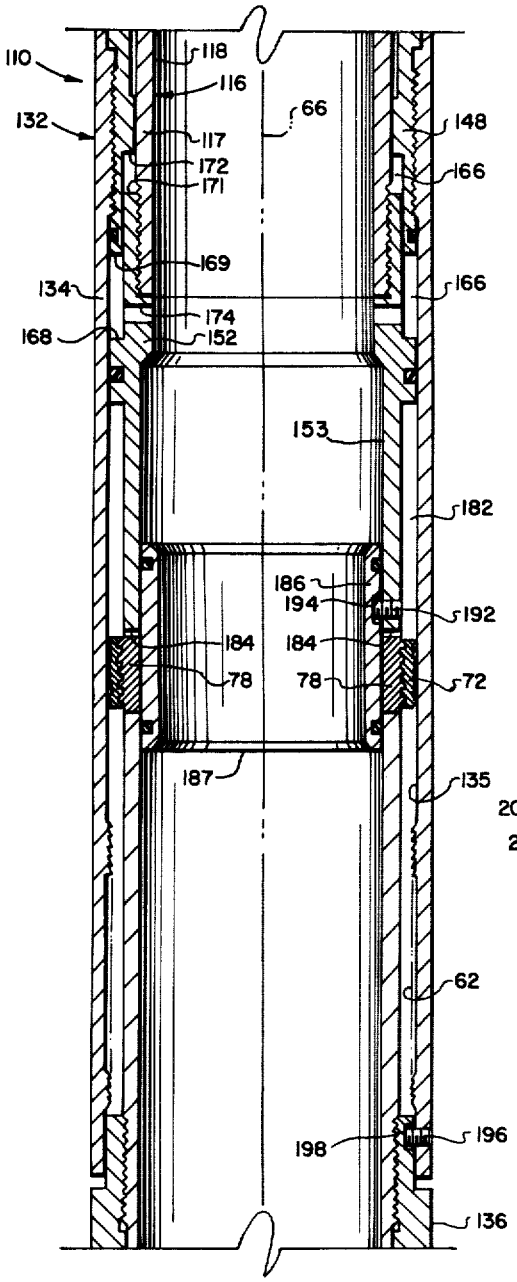
Figure 4D:
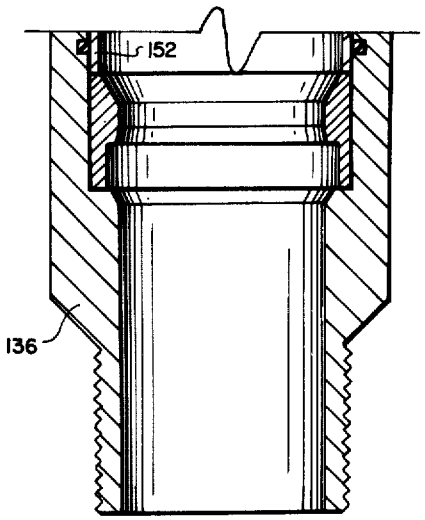

Referring to FIG. 4C, the packer 110 also includes a stepped expansible chamber 166 formed between axially facing annular pressure surfaces 168 and 171 on the member 152 and opposed pressure surfaces 169 and 172 formed on the housing member 148. Pressure fluid may be admitted to the chamber 166 through a passage 174 which opens into the bore 118.

An elongated annular clearance space 182 is formed between the inner wall of the member 134 and the outer cylindrical wall of the member 152 as shown in FIG. 4C. The inner wall 135 of the member 134 includes axially spaced teeth 63 provided in the same manner as on the inside wall 35 of the housing of the packer 10. The packer 110 also includes two diametrally opposed axially extending slots 184, similar to the slots 80, and formed in the wall of the member 152. Segments 78 are disposed in the respective slots 184 and are retained therein by a cylindrical tubular retaining sleeve 186 closely fitted but slidable within the bore 153 of the member 152. The sleeve 186 is retained in position over the slots 184 by a suitable shear pin 192 which projects into a recess 194 in the outer circumferential wall of the sleeve. The packer 110 is also provided with the lock ring 72 engageable with the segments 78 in the position shown in FIG. 4C. The lock ring 72 is also adapted to engage the teeth 62 in response to axial movement of the mandrel 116 with respect to the housing 132.

The packer 110 includes means for preventing premature movement of the mandrel 116 with respect to the housing 132. The lower end of the member 134 includes a plurality of radially inwardly projecting shear pins 196, one shown, which are engageable with cooperating recesses 198 in the sub 136. The packer 110 may also be provided with radially outwardly biased drag blocks 200, FIG. 4B, mounted on the housing member 148 and biased for engagement with the inner wall of the casing by coil spring members 202. The drag blocks 200 provide for more precise control over positioning and holding the packer 110 prior to actuation to set the packer.

In the operation of the packer 110 to be set by the application of pressure fluid to the chamber 166 the packer would be provided with an expendable plug engaged with the lower sub 136 to block off the interior bore 118 of the packer whereby pressure fluid could be introduced into the bore and into the chamber 166. By suitably increasing the pressure of the fluid in the chamber 166 the pins 196 would shear at a predetermined fluid pressure whereupon the mandrel 116 would be free to move with respect to the housing 132 to set the slips 145 and the sealing elements 28. Axial movement of the mandrel 116 with respect to the housing member 134 upon shearing of the pins 196, would cause engagement of the teeth 70 on the lock ring 72 with the teeth 62 to form a locking interconnection between the mandrel 116 and the housing 132 upon setting of the packer in the desired position.

In many applications of setting the packer 110 the fluid pressure within the well casing above the sealing elements 28 may be greater than the pressure in the casing below the sealing elements. In such an instance fluid pressure in the chamber 158 and acting on the piston face 157 could be operable to boost the forces tending to move the mandrel 116 downwardly with respect to the housing 132 through engagement of cooperating annular surfaces 161 and 163 on the respective members 117 and 156 as shown in FIG. 4A.

When it is desired to retrieve the packer 110 a suitable retrieving tool is lowered through the bore 118 to a point below the transverse bottom edge 187 of the retaining sleeve 186 whereby, upon engagement of the surface 187 and exertion of an upward pulling force by the retrieving tool, the pins 192 are sheared to move the sleeve upwardly in the bore 153. As soon as the bottom edge 187 of the sleeve clears the upper edge of the slots 184 the segments 78 are forced radially inwardly toward the bore of the mandrel 116 to release the locking interconnection between the mandrel and the housing 132 whereby the packer is ready for retrieval from the well.

Figure 5:
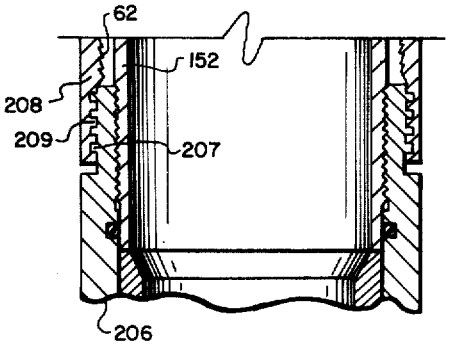
FIG. 5 is a detail section view of the lower end of the embodiment shown in FIGS. 4A through 4D illustrating a variation of the setting connection between the packer housing and mandrel.

Referring to FIG. 5, a variation of the interconnection between the sub 136 and the housing member 134 is illustrated. In the detailed view of FIG. 5, there is shown a sub 206 similar in most respects to the sub 136 but including axially extending helical threads 207 engageable with cooperating threads 209 on a modified housing member 208 which also has teeth 62 arranged in the same manner as the teeth 62 are arranged on the housing 134. By interchanging the members 206 and 208 for the members 136 and 134, respectively, and by removing the screws 150, the packer 110 may be mechanically set by rotating the mandrel 116 when the packer has been run to the set position. The drag blocks 200 exert a substantial force between the housing and the well casing to prevent rotation of the housing 132 whereby, upon rotation of the mandrel 116, the members 206 and 208 would be threadedly disengaged. Then the mandrel 116 may be lowered to effect longitudinal movement of the mandrel with respect to the housing in a direction to effect setting of the slips 145 and the sealing elements 28. The retrieving operation for the packer 110 with the alternate members 208 and 206 would be the same as previously described.

Accordingly, the embodiment illustrated in FIGS. 4A through 4D and FIG. 5 enjoys all of the advantages of the embodiment shown in FIGS. 1 through 3 and is adapted for supporting heavy tailpipe loads below the packer.

Moreover, the packer 110 may be set by first releasing the mandrel from the housing, either by applying pressure fluid directly to an expansible chamber to shear the shear screws, or by rotation of the mandrel with respect to the outer housing to unscrew a threaded coupling. The packer can then be set either by hydrualic pressure in the expansible chamber, by setting down the weight of the string on the mandrel, or by a conventional wireline setting tool.

Figure 6A:
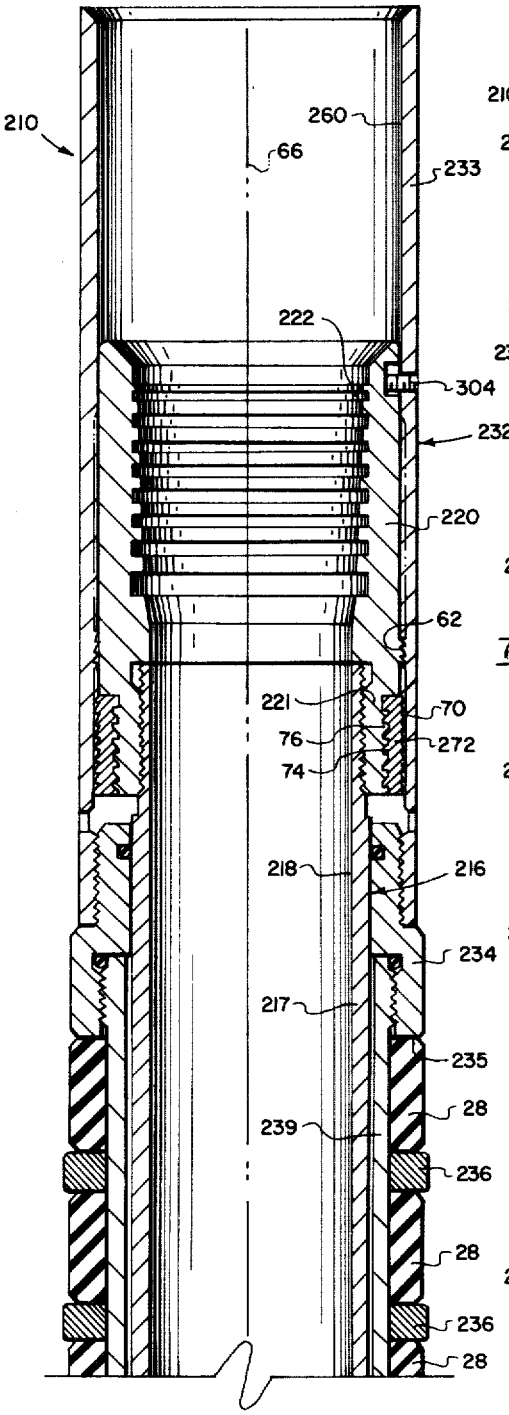
FIGS. 6A through 6C together comprise a vertical elevation, in section, of a second alternate embodiment of the present invention.
Figure 6B:
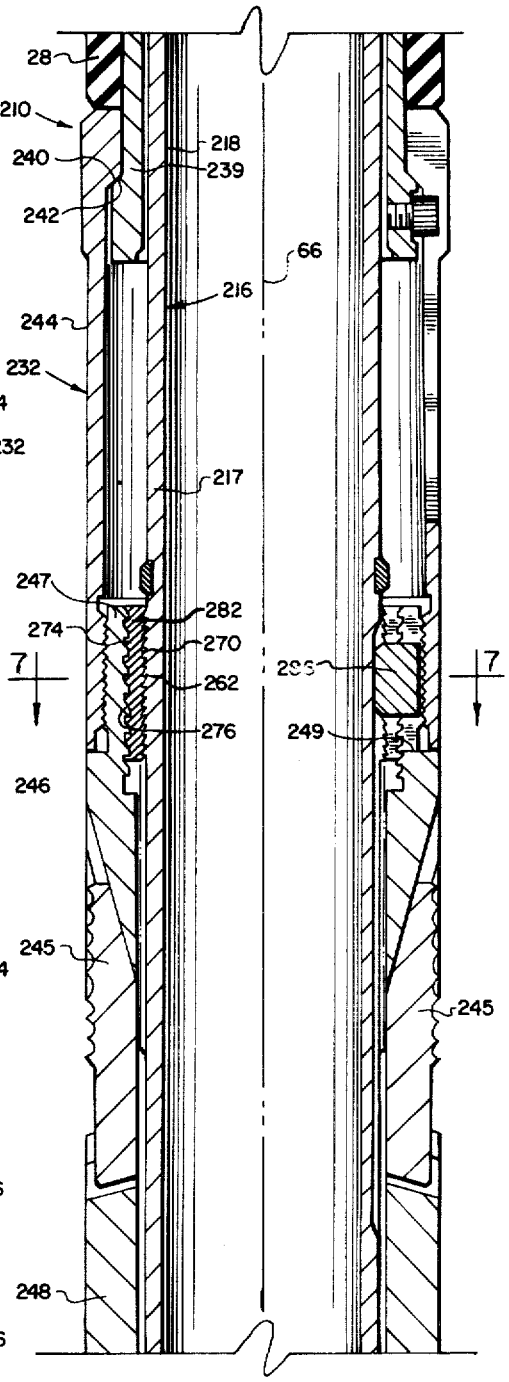
Figure 6C:
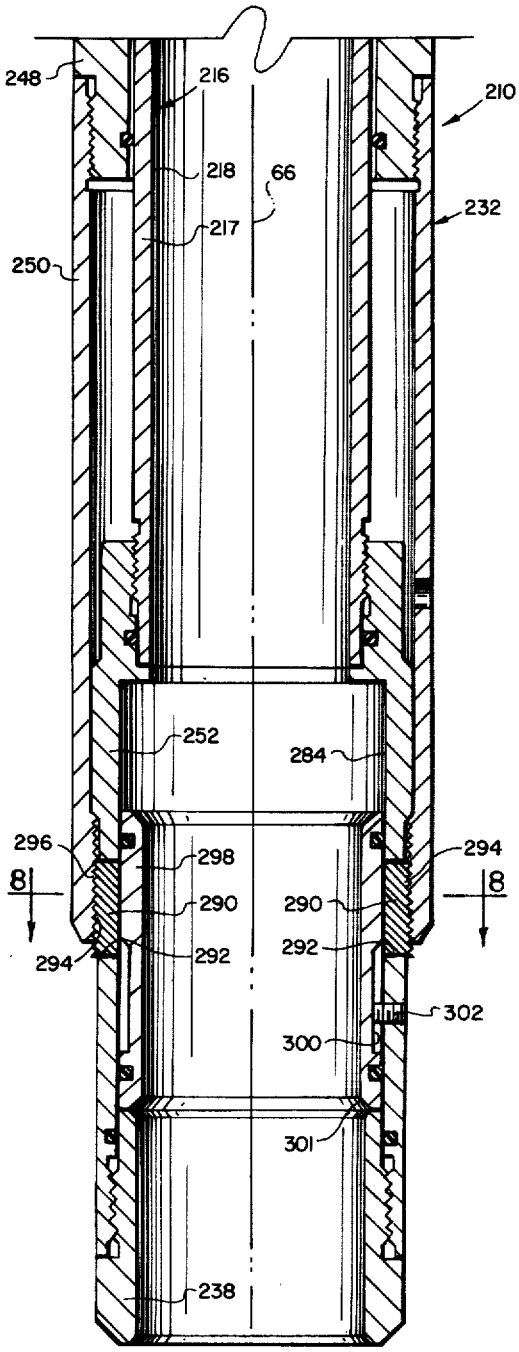

A second alternate embodiment of a retrievable well packer in accordance with the present invention is illustrated in FIGS. 6A through 6C, FIG. 7 and FIG. 8. Referring to FIGS. 6A through 6C, a retrievable well packer is illustrated and generally designated by the numeral 210. The packer 210 includes a mandrel 216 including an elongated tubular member 217 having an axial bore 218 and being threadedly connected to a top sub 220. The sub 220 is provided with suitable internal threads 222 for engagement with suitable setting and retrieving equipment. The lower end of the tubular member 217 is threadedly connected to the upper end of a further tubular member 252, as shown in FIG. 6C. The member 252 includes a bore 284 and is threadedly connected at its lower end to a bottom sub 238.

The packer 210 includes an elongated outer housing, generally designated by the numeral 232, and which includes an elongated sleeve 233 extending axially upwardly above the sub 220 in surrounding relationship thereto. The sleeve 233 is threadedly engaged at its lower end with a housing member 234 having a downwardly facing annular shoulder 235 engaged with one side of a resilient sealing element 28. The packer 210 includes three sealing elements 28, generally side by side, as in the previous embodiments but having rigid spacer elements 236 interposed between each of the resilient elements. The elements 28 and 236 are disposed on an elongated sleeve portion 239 of the housing 232 which is threadedly connected to the member 234 at its upper end. The sleeve member 239 is adapted to have a shoulder 240 which is engageable with a cooperating shoulder 242 formed on a further tubular member 244. The member 244 is threadedly engaged at its lower end with a member 246 comprising a slip cone for engaging and moving slips 245 radially outwardly into engagement with the inner wall of the well casing. The lower ends of the slips 245 are suitably engaged with a housing member 248 which is threadedly engaged with a lower tubular portion 250. The slip system of the packer 210, formed by the members 245, 246 and 248, is slightly different from the slip systems 44 and 144 shown in the previously described embodiments. However, the slip arrangement of the packer 210 is believed to be readily understandable to those skilled in the art and further structural detail will not be described for the sake of conciseness.

The locking and releasing mechanism of the packer 210 includes axially spaced teeth 62, FIG. 6A, formed on the inner cylindrical wall 260 of the sleeve 233 but having their respective flank portions facing in the opposite direction to that shown for the embodiments of the present invention illustrated in FIGS. 1 through 5. The teeth 62 formed on the member 233 are engaged with cooperating axially spaced teeth 70 formed on a lock ring 272 similar to the lock ring 72. The lock ring 272 is further provided with coarse teeth 74 formed on an inner cylindrical wall and engageable with cooperating teeth 76 formed on a depending portion 221 of the sub 220.

Figure 7:
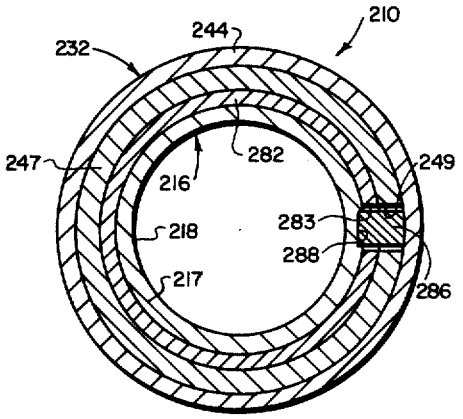
FIG. 7 is a transverse section view taken along the line 7—7 of FIG. 6B.

Referring to FIG. 6B and FIG. 7, the packer 210 is provided with further locking means comprising a plurality of axially spaced teeth 262 formed on the exterior surface of the mandrel member 217. The teeth 262 are inclined in the same direction as the teeth 62 in the embodiments of the present invention illustrated in FIGS. 1 through 5 of the drawings. A lock ring 282 is disposed around the member 217 and includes axially spaced teeth 270, similar to the teeth 70 and engageable with the teeth 262. The lock ring 282 includes coarse teeth 274 on its outer cylindrical surface which are engageable with cooperating teeth 276 formed on an axially upwardly projecting portion 274 of the member 246. As shown in FIG. 7, an axially extending slot 249 is formed in the member 246 and is aligned with a slot 283 extending axially through the lock ring 282. A generally rectangular key 286 is disposed in the slots 249 and 283 and extends into a groove 288 formed in the outer wall of the tubular member 217.

Figure 8:
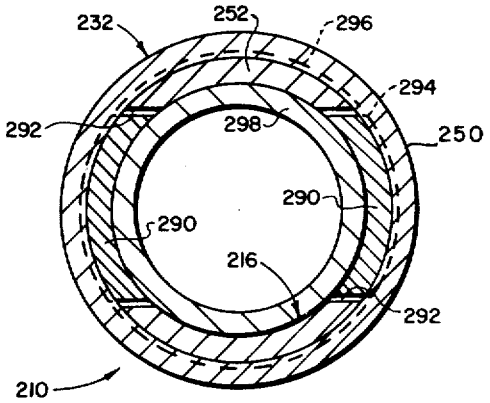
FIG. 8 is a transverse section view taken along the line 8—8 of FIG. 6C.

Referring to FIG. 6C and FIG. 8 the locking and release mechanism of the packer 210 includes a pair of diametrally opposed cylindrical segments 290 disposed in respective axially extending slots 292 in the member 252. The segments 290 are provided with a series of axially spaced teeth or threads 294 on the outer surface thereof and engaged with cooperating internal axially spaced teeth or threads 296 formed on the distal end of the member 250. In the position shown in FIG. 6C of the drawings, the segments 290 are adapted to form a locking interconnection between the mandrel 216 and housing 232, and the segments are retained in the position shown by an elongated retaining sleeve 298 slidably disposed in the bore 284. The sleeve 298 includes a circumferential recess 300 adapted to be positioned adjacent to the slots 292 when the sleeve is moved upwardly viewing FIG. 6C. The sleeve 298 is retained in the position shown in FIG. 6C by radially projecting shear pins 302, one shown, fixed in the member 252 and projecting into the recess 300.

The packer 210 is adapted to be set from the top end by effecting relative movement between the mandrel 216 and the housing 232. In particular, the packer 210 may be set by a top setting assembly such as a Baker Packers Model E4 wireline pressure setting assembly in conjunction with a Model B wireline adapter kit. In the use of the abovementioned type of equipment the housing member 233 is engaged and moved downwardly with respect to the mandrel 216, shearing pins 304, one shown, and causing radial outward movement of the slips 245 and the sealing elements 28 to set the packer. When the sleeve 233 undergoes relative movement with respect to the sub 220 the lock ring 272 is constricted radially inwardly to provide for ratcheting of the teeth 70 with respect to the teeth 62. When the mandrel 216 and housing 232 have undergone relative longitudinal movement sufficient to set the packer the respective elements remain in a locked position due to the lock ring 272 cooperating with the members 233 and 221. Moreover, the locking interconnection provided by the segments 290 also prevent relative movement between the mandrel 216 and the housing 232 in the set position. The lock ring 282 also moves with respect to the mandrel 216 to set up a locking connection between the slip member 246 and the mandrel member 217 in the set position of the mandrel with respect to the housing 232.

When it is desired to release the packer 210 from the set position for retrieval, a retrieving tool is run through the bore 218 to a point wherein suitable mechanism may engage a generally transverse end face 301 of the retaining sleeve 298 and, upon application of sufficient upward axial force, cause the pins 302 to shear and displace the retaining sleeve 298 upwardly until the segments 290 may be displaced radially inwardly into the recess 300. When the teeth 294 disengage from the cooperating teeth 296 the housing members 250 and 248 will move downwardly to retract the slips 245. Moreover, the arrangement of the lock rings 272 and 282 will provide for axial movement of the housing member 244 downwardly, viewing FIG. 6B, until the shoulders 240 and 242 engage to permit the sealing elements 28 to resume the retracted position shown. The packer 210, being released from its set position, may then be raised out of the well.

The packer 210 is also of a design which is adapted to handle relatively heavy tailpipe loads thanks to the continuous inner mandrel 216 which is connected to both the upper and lower subs 220 and 238, respectively. Although the sub 238 shown is not provided with threads for connecting tailpipe to the packer, the sub 238 may be easily interchanged with a suitable sub for attaching further equipment below the packer.

Although the present invention has been described herein in terms of several specific embodiments it will be understood that this is by illustration only and that the invention is not necessarily limited to the specific embodiments shown since further alternate embodiments will be apparent to those skilled in the art upon reading of the foregoing disclosure. Accordingly, modifications to the present invention may be made without departing from the scope and spirit of the appended claims.

What I claim is:

1. A retrievable apparatus adapted to be inserted in a first subterranean conduit means such as a well to provide a seal in the annulus formed between the first conduit means and a second conduit means disposed therein comprising:

tubular mandrel means adaptable to be sealingly associated with the second conduit means having first seal urging means at one end of the mandrel means;

housing means disposed around the end of the mandrel means opposite the first seal urging means and including second seal urging means, the housing means being moveable relative to the mandrel means whereby the first and second seal urging means will apply in axial compression force to annular sealing means disposed therebetween;

annular sealing means disposed between the first and second seal urging means adapted to be urged outwardly into sealing engagement with the first conduit means in response to axial compression by the urging means, and to contract when such axial compression is removed;

a selectively releasable latching system cooperatively coupled between the housing and the end of the mandrel means opposite the first urging means for permitting movement of the housing relative to the mandrel means to move the first seal urging means toward the second seal urging means and thereby apply a compressive force to the sealing means therebetween and then holding the relative positions of the mandrel means and housing means until selectively released to remove the compressive force on the sealing means and permit retrieval of the apparatus, the latching system including:

ratchet means for permitting relative movement between the housing and the ratchet means in a direction to apply a compressive force to the sealing means and hold the compressive force on the sealing means, and selectively releasable coupling means coupling the ratchet means to the mandrel means, the coupling means including sleeve means disposed within the mandrel means and axially shiftable from a first position to a second position to decouple the ratchet means from the mandrel means and thereby release the compressive force held on the sealing means.

2. The retrievable apparatus of claim 1 wherein:

first coupling means on said one end of the mandrel means adapted to couple the mandrel means to the second conduit means, second coupling means on the end of the housing means opposite said one end of the mandrel means adapted to connect a continuation of the second conduit means to the housing means, and interacting shoulder means formed on the mandrel means and housing means respectively for transmitting tensile loads through the apparatus.

3. The retrievable apparatus of claim 1 further characterized by:

expansible fluid chamber means for applying a force acting between the mandrel means and housing means to provide relative movement therebetween in a direction to apply a compressive force to the sealing means through the first and second seal urging means.

4. The retrievable apparatus of claim 1 wherein the interior of the mandrel means forms a bore in which a tubular continuation of the second conduit may extend, the mandrel means adapted to form an annular fluid seal with the tubular continuation.

5. The retrievable apparatus of claim 1 further characterized by:

means on the housing for frictionally engaging the first conduit means, and coupling means for coupling the mandrel means to the second conduit means, whereby a downward force on the mandrel means by the second conduit means will provide relative movement between the mandrel means and the housing means as the frictional means resists movement of the housing means to thereby apply the compressive force to the sealing means.

6. The retrievable apparatus of claim 1 further characterized by:

coupling means on the mandrel means for connecting the mandrel means to setting apparatus, and means associated with the housing means cooperatively engageable by the setting apparatus for providing the relative movement between the first and second seal urging means to apply the compressive force to the sealing means.

7. A retrievable apparatus adapted to be inserted in a first subterranean conduit means such as a well to provide a seal in the annulus formed between the first conduit and a second conduit disposed therein comprising:

tubular mandrel means adaptable to be sealing associated with the second conduit having first seal urging means at one end of the mandrel means;

housing means disposed around the the other end of the mandrel means and including second seal urging means spaced from the first seal urging means and moveable relative to the mandrel means such that the seal urging means can apply an axial compression force to sealing means disposed therebetween;

annular sealing means disposed between the first and second seal urging members adapted to be urged outwardly into sealing engagement with the first conduit means in response to axial compression by the seal urging means, and to retract out of engagement when such axial compression is removed; and a selectively releasable latching system cooperatively coupling the housing and mandrel means for permitting movement of the housing relative to the mandrel means to thereby move the first and second seal urging means together to compress the sealing means and then holding the relative positions of the mandrel means and housing means until selectively released to remove the compressive force on the sealing means and permit retrieval of the apparatus, the ratchet system comprising;

a lock ring means having wicker means on the outer circumference and complementary wicker means on the housing means engageable therewith to permit movement of the housing relative to the mandrel means in the direction to apply a compressive force to the sealing means and to then hold the final position of the movement to maintain the compressive force on the sealing means;

collapsible means coupled to the mandrel means and moveable between an expanded position and a collapsed position, cooperatively engageable means to the collapsible means and on the lock ring means for preventing relative axial movement therebetween when the collapsible means is in the expanded position and permitting relative axial movement therebetween when the collapsible means is in the collapsed position, and axially shiftable sleeve means holding the collapsible means in the expanded position when the sleeve means is in a first position and permitting the collapsible means to move to the collapsed position when shifted to a second position.

8. A retrievable apparatus adapted to be inserted in a first subterranean conduit means such as a well to provide a seal in the annulus formed between the first conduit means and a second conduit means disposed therein comprising:

tubular mandrel means adaptable to be sealingly associated with the second conduit means having first seal urging means at one end of the mandrel means;

housing means disposed around the end of the mandrel means opposite the first seal urging means and including second seal urging means, the housing means being moveable relative to the mandrel means whereby the first and second seal urging means will apply an axial compression force to the annular sealing means disposed therebetween;

annular sealing means disposed between the first and second seal urging means adapted to be urged outwardly into sealing engagement with the first conduit means in response to axial compression by the urging means, and to contract when such axial compression is removed;

a selectively releasable latching system cooperatively coupled between the housing and the end of the mandrel means opposite the first urging means for permitting movement of the housing relative to the mandrel means to move the first seal urging means toward the second seal urging means and thereby apply a compressive force to the sealing means therebetween and then holding the relative positions of the mandrel means and housing means until selectively released to remove the compressive force on the sealing means and permit retrieval of the apparatus, the latching system including:

ratchet wicker means formed on the housing adjacent the end portion of the mandrel means opposite the first seal urging means, a lock ring disposed between the housing and the mandrel means, the lock ring forming complementary ratchet wicker means to those formed on the housing the lock ring being split to allow inward flexing and the ratchet wicker means being arranged to permit movement of the housing relative to the lock ring toward the first seal urging means but not away from the first seal urging means;

latch means coupled to the mandrel means and moveable between a radially expanded position and a collapsed position, sleeve means axially shiftable between first and second positions and holding the latch means in the expanded position when in the first position and permitting the latch means to move to the collapsed position when shifted to the second position; and cooperatively engageable means formed on the latch means and on the lock ring for intercoupling the latch means on the lock ring while permitting the operative interaction of the first and second ratchet means while the latch means is in the expanded position and for decoupling the latch means and the lock ring when the latch means is in the collapsed position.

* * * * *